US005358545A

United States Patent [19]

Nagro

[11] Patent Number: 5,358,545

[45] Date of Patent: Oct. 25, 1994

[54] CORROSION RESISTANT COMPOSITION FOR WEAR PRODUCTS

[75] Inventor: Louis A. Nagro, Columbus, N.C.

[73] Assignee: Carmet Company, Duncan, S.C.

[21] Appl. No.: 57,220

[22] Filed: May 4, 1993

Related U.S. Application Data

[63] Continuation of Ser. No. 584,294, Sep. 18, 1990, abandoned.

[51] Int. Cl.[5] ..... C22C 29/06; C22C 29/10

[52] U.S. Cl. ..... 75/236; 75/246

[58] Field of Search ..... 75/236, 246

[56] References Cited

U.S. PATENT DOCUMENTS

| | | | |
|---|---|---|---|
| 2,654,145 | 10/1952 | Graham | 29/182.8 |
| 2,828,202 | 3/1958 | Goetzel et al. | 29/182.8 |
| 3,369,891 | 2/1968 | Tarkan et al. | 29/182.7 |
| 3,369,892 | 2/1968 | Ellis et al. | 75/123 |
| 3,380,861 | 4/1968 | Frehn | 29/182.7 |
| 3,628,921 | 12/1971 | Franklin | 29/182.7 |
| 3,723,077 | 3/1973 | Frehm | 29/182.7 |
| 3,725,016 | 4/1973 | Mal et al. | 29/182.3 |
| 3,782,930 | 1/1974 | Shibata | 75/204 |
| 3,850,583 | 11/1974 | Kueny | 29/182.7 |
| 3,966,423 | 6/1976 | Mal et al. | 29/182.7 |
| 3,977,837 | 8/1976 | Mal et al. | 29/182.7 |
| 4,043,843 | 8/1977 | Tanczyn | 148/37 |
| 4,180,401 | 12/1979 | Frehn | 75/236 |
| 4,556,424 | 12/1985 | Viswanadham | 75/240 |
| 4,704,336 | 11/1987 | Spriggs | 428/552 |
| 4,853,182 | 8/1989 | Cornie et al. | 420/129 |
| 5,053,074 | 10/1991 | Buljan et al. | 75/236 |
| 5,066,546 | 11/1991 | Materkowski | 428/627 |

OTHER PUBLICATIONS

Schwarzkopf and Kieffer, "Cemented Carbides," Macmillan Co., 1960. pp. 1-11.

*Primary Examiner*—Donald P. Walsh
*Assistant Examiner*—Daniel Jenkins
*Attorney, Agent, or Firm*—McAndrews, Held & Malloy, Ltd.

[57] ABSTRACT

A novel and improved cemented carbide composition, particularly for tools and other wear products, is provided comprising about 62% to 90% titanium carbide, about 0% to 10% nickel, 0% to about 25% other suitable carbides selected from the group of $Mo_2C$, TaC, HfC, NbC, VC, WC and $Cr_3C_2$, and about 10% to 38% stainless steel binder. The light weight composition provides an improvement in the combined properties of hardness, toughness, strippability, corrosion resistance and wear resistance.

21 Claims, No Drawings

CORROSION RESISTANT COMPOSITION FOR WEAR PRODUCTS

This application is a continuation of application Ser. No. 07/584,294, filed Sep. 18, 1990, now abandoned.

BACKGROUND OF THE INVENTION

Cemented carbide compositions containing a hard metal carbide bonded by a metal alloy binder are well known in the art. For example, see U.S. Pat. Nos. 3,628,921; 4,180,401; 3,369,891; 3,369,892; 3,723,077; 3,725,016; 3,380,861; 3,782,930; 3,850,583; 4,704,336; 4,556,424; 3,977,837;, 2,828,202; 3,966,423; and 2,654,145. The hard metal carbide is typically a tungsten or titanium carbide. The metal alloy binder or matrix is typically an iron group metal. The cemented carbide compositions generally are made by well-known powdered metal metallurgical techniques.

Cemented carbide compositions are particularly adapted for tools or other wear products which require hard and wear resistant compositions. In their applications, cemented carbide compositions also may be exposed to corrosive environments, such as acids or alkalis, which promote crevice, galvanic and chemical attack upon the composition. When used as a tool in connection with high speed punches or other mechanical equipment to cut or form materials, a cemented carbide composition having a relative light weight, high toughness, and high strippability (i.e., low coefficient of friction) offers economic advantages through reduced maintenance, increased productivity, and reduced replacement expenses.

The problem, which is the basis for the invention, is to create a cemented carbide composition which adequately exhibits the combined properties of relative light weight, hardness, toughness, corrosion resistance, strippability and wear resistance for tools and other wear products. The prior art cemented carbide compositions, set forth in the patents identified above, generally comprise components which address some, but not all, of the desired properties. By doing so, the prior art compositions excessively trade off one desired property for one or more other properties.

SUMMARY OF THE INVENTION

One object of the present invention is to provide a new and improved cemented carbide composition.

Another object of the present invention is to provide improved tools and other wear products from the new and improved cemented carbide compositions having the combined properties of relative light weight and high hardness, toughness, corrosion resistance, strippability and wear resistance.

Further objects and improvements of the present invention will be apparent upon reading the specification and claims.

According to the present invention, the compositions and wear products are formed utilizing powder metallurgy methods of fabrication. The improved cemented carbide composition contains, by weight, about 62% to 90% titanium carbide, about 0% to 25% other suitable carbides selected from the group of, but not limited to, $Mo_2C$, TaC, HfC, NbC, VC, WC and $Cr_3C_2$, about 0% to 10% nickel, and about 10% to 38% stainless steel binder.

The cemented carbide compositions of the present invention are relatively light weight and possess outstanding properties of hardness, toughness, strippability, corrosion resistance and wear resistance. These properties make the cemented carbide compositions particularly advantageous for use as wear products such as seal rings or tools in connection with high speed processes involving material cutting or removal, metal forming or deforming, or the like.

DETAILED DESCRIPTION OF THE PREFERRED EMBODIMENT

The cemented carbide compositions of the present invention are produced by powder metallurgy techniques. Powder metallurgy techniques are, in general, well-known in the art and include pressing a mixture of powders of the desired carbides and binder metals and then sintering the pressed mixture of powders to form a cemented composition.

More particularly, a powder mixture of titanium carbide, Type 316 stainless steel, nickel and other suitable carbides including, but not limited to, one or more of $Mo_2C$, TaC, HfC, NbC, VC, WC and $Cr_3O_2$ are prepared. The suitable carbides may be used singularly or in various combinations. Using wellknown mixing techniques, this mixture may be mixed and sized, for example, in a ball mill (about 5 days) or attrition mill (about 4 to 6 hours) wherein the powders are suspended in a suitable solvent such as acetone or hexane. The milled powder is then dried by evaporating the solvent.

The dried, milled powder is then mixed with a suitable binder-lubricant such as about 4% to 6% paraffin and pressed or compacted into a predensified state. The pressed mixture is breached up into conglomerates of suitable size. Thereafter the mixture is poured into a mold to form the desired shape and pressed at 10 to 20 tons per square inch.

Prior to sintering, the pressed, shaped mixture may be machined by a lathe such as a computer numeric control (CNC) machine to obtain the desired geometry. Then, the pressed, shaped mixture is wrapped with a protective, commercially available aluminum oxide paper, such as Cotronics Type 300, or other protective coating or film to prevent the carburizing of the metal binder during sintering. The final sintering is generally carried out under reduced pressure, or in an inert atmosphere such as hydrogen, in a furnace at about 1400–1460° C. for about one hour.

After sintering, the aluminum oxide or other protective layer is removed and the sintered article may be ground to exact dimensions through well-known grinding techniques.

The improved cemented carbide composition contains, by weight, about 62% to 90% titanium carbide, about 0% to 25% other suitable carbides selected from the group of, but not limited to, $Mo_2C$, TaC, HfC, NbC, VC, WC and $Cr_3C_2$, about 0% to 10% nickel and about 10% to 38% stainless steel binder. The steel may comprise, by weight, about 10% to 20% chromium, 5% to 15% nickel, 0% to 3% molybdenum, 0% to 3% manganese, 0% to 2% silicon, and the remainder iron. The preferred cemented carbide compositions contain, by weight, about 62% to 75% titanium carbide, 20% to 30% Type 316 stainless steel, 3% to 7% nickel, and 0% to 7% of one or more other suitable carbides selected from a group, but not limited to, $Mo_2C$, TaC, HfC, NbC, VC, WC and $Cr_3O_2$.

Useful cemented carbide compositions for wear products including tools or seal rings were prepared with the following compositions by weight:

Composition A

About 70% TiC
About 5% Ni
About 5% $Mo_2C$
About 20% 316 stainless steel having a nominal composition of 69% Fe, 16% Cr, 10% Ni, 2% Mn, 2% Mo and 1% Si.

The resultant compositions have an average hardness of about 90.5 HRa, a density of about 5.45 g/cc, and a transverse rupture strength of about 210,000 psi. The novel composition is relatively light weight compared to compositions predominantly comprised of steel, tungsten carbide or other heavy carbides. The novel composition showed a significantly improved weight loss factor compared to a composition comprising, by volume, about 90% tungsten carbide and 10% nickel in static chemical corrosion tests conducted in 10% HCl and 10% $NH_4OH$ solutions.

Other useful cemented carbide compositions were prepared with the following compositions by weight:

Composition B

About 62.5% TiC
About 5.0% Ni
About 6.0% $Mo_2C$
About 26.5% 316 stainless steel having a nominal composition of 69% Fe, 16% Cr, 10% Ni, 2% Mn, 2% Mo and 1% Si.

The resultant compositions have an average hardness of about 89.0 HRa, density of about 5.75 g/cc, and a transverse rupture strength of about 250,000 psi.

The novel compositions also are useful when formed as a punch sleeve in connection with a can punching process. In testing, the novel compositions performed satisfactory while being lighter than regular tungsten carbide or steel sleeves, showing improved strippability properties to increase productivity, and showing improved resistance to the corrosive attack of the coolants used in the can punching process. For comparison purposes relative to can punch processes, the typical steel punch sleeve generally weighs about 4.7 lbs., the regular tungsten carbide sleeve generally weighs about 6.1 lbs., and the punch sleeve utilizing the novel compositions of the present invention generally weighs about 2.6 lbs.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and claims.

What is claimed is

1. A sintered cemented carbide composition comprising by weight from 62% to about 90% titanium carbide and the balance stainless steel matrix.

2. The carbide composition as in claim 1, wherein the stainless steel matrix comprises by weight about 10% to about 20% chromium, about 5% to about 15% nickel, 0% to about 3% molybdenum, 0% to about 3% manganese, 0% to about 2% silicon, and the balance iron.

3. A sintered cemented carbide composition comprising by weight from 62% to about 90% titanium carbide, about 0% to about 10% nickel, 0% to about 25% of one or more of the carbides selected from the groups, but not limited to, $Mo_2C$, TaC, HfC, NbC, VC, WC and $Cr_3C_2$, and about 10% to about 38% stainless steel matrix.

4. The carbide composition as in claim 3, wherein the titanium carbide comprises from 62% to about 75% by weight.

5. The carbide composition as in claim 4, wherein the nickel comprises about 3% to about 7% by weight and the carbides other than titanium carbide comprise 0% to about 7% by weight.

6. The carbide composition as in claim 5, wherein the stainless steel matrix comprises by weight about 10% to about 20% chromium, about 5% to about 15% nickel, 0% to about 3% molybdenum, 0% to about 3% manganese, 0% to about 2% silicon, and the balance iron.

7. A sintered cemented carbide composition comprising by weight about 70% titanium carbide, about 5% nickel, about 5% $Mo_2C$ and the balance stainless steel matrix.

8. The carbide composition as in claim 7, wherein the stainless steel matrix comprises about 10% to about 20% chromium, about 5% to about 15% nickel, 0% to about 3% molybdenum, 0% to about 3% manganese, 0% to about 2% silicon, and the balance iron.

9. The carbide composition as in claim 7, wherein the stainless steel matrix comprises Type 316 stainless steel.

10. A wear product comprised of a sintered cemented carbide composition, comprising by weight from 62% to about 90% titanium carbide and the balance stainless steel matrix.

11. The wear product as in claim 10, wherein the carbide composition further comprises by weight about 0% to about 10% nickel and 0% to about 25% of one or more of the carbides selected from the group, but not limited to, $Mo_2C$, TaC, HfC, NbC, VC, WC and $Cr_3C_2$.

12. The wear product as in claim 10 wherein the stainless steel matrix comprises by weight about 10% to about 20% chromium, about 5% to about 15% nickel, 0% to about 3% manganese, 0% to about 3% molybdenum, 0% to about 2% silicon, and the balance iron.

13. A wear product comprised of a sintered cemented carbide composition, comprising by weight from 62% to about 75% titanium carbide, about 3% to about 7% nickel, 0% to about 7% $Mo_2C$ and the balance stainless steel matrix.

14. The wear product as in claim 13, wherein the stainless steel matrix comprises Type 316 stainless steel.

15. The wear product as in claim 14, wherein the stainless steel comprises by weight about 10% to 20% chromium, about 5% to about 15% nickel, 0% to about 3% molybdenum, 0% to about 3% manganese, 0% to about 2% silicon, and the balance iron.

16. A wear product comprised of a sintered cemented carbide composition, comprising by weight about 70% to about 90% titanium carbide and the balance stainless steel matrix.

17. The wear product as in claim 1, wherein the stainless steel matrix comprises by weight about 10% to about 20% chromium, about 5% to about 15% nickel, 0% to about 3% molybdenum, 0% to about 3% manganese, 0% to about 2% silicon, and the balance iron.

18. A sintered cemented carbide composition comprising by weight about 62% to about 90% titanium carbide, about 0% to about 10% nickel, 5% to about 25% of one or more of the carbides selected from the group, but not limited to, $Mo_2C$, TaC, HfC, NbC, VC, WC and $Cr_3C_2$, and about 10% to about 38% stainless steel matrix.

19. The carbide composition as in claim 18, wherein the titanium carbide comprises about 62% to about 75% by weight.

20. The carbide composition as in claim 19, wherein the nickel comprises about 3% to about 7% by weight and the carbides other than titanium carbide comprise about 5% to about 10% by weight.

21. The carbide composition as in claim 20, wherein the stainless steel matrix comprises by weight about 10% to about 20% chromium, about 5% to about 15% nickel, 0% to about 3% molybdenum, 0% to about 3% manganese, 0% to about 2% silicon, and the balance iron.

* * * * *